US008240357B2

(12) United States Patent
Reifferscheid et al.

(10) Patent No.: US 8,240,357 B2
(45) Date of Patent: Aug. 14, 2012

(54) EXTRUSION DIE

(75) Inventors: Markus Reifferscheid, Korschenbroich (DE); Albrecht Girgensohn, Duesseldorf (DE)

(73) Assignee: SMS Siemag AG, Dusseldorf (DE)

( * ) Notice: Subject to any disclaimer, the term of this patent is extended or adjusted under 35 U.S.C. 154(b) by 207 days.

(21) Appl. No.: 12/312,095

(22) PCT Filed: Oct. 18, 2007

(86) PCT No.: PCT/DE2007/001884

§ 371 (c)(1),
(2), (4) Date: Jul. 17, 2009

(87) PCT Pub. No.: WO2008/049398

PCT Pub. Date: May 2, 2008

(65) Prior Publication Data

US 2010/0059195 A1 Mar. 11, 2010

(30) Foreign Application Priority Data

Oct. 26, 2006 (DE) ..... 10 2006 051 171

(51) Int. Cl.
*B22D 11/055* (2006.01)

(52) U.S. Cl. ..... 164/443; 164/418

(58) Field of Classification Search ..... 164/443, 164/485, 418, 459

See application file for complete search history.

(56) References Cited

U.S. PATENT DOCUMENTS

| | | | | |
|---|---|---|---|---|
| 5,207,266 | A | 5/1993 | Nakashima et al. | |
| 6,318,448 | B1 | 11/2001 | Fehlemann | |
| 6,742,571 | B2 * | 6/2004 | Yamasaki et al. | 164/418 |
| 2004/0069439 | A1 | 4/2004 | Hugenschütt et al. | |

FOREIGN PATENT DOCUMENTS

| | | |
|---|---|---|
| DE | 198 26 522 | 12/1999 |
| EP | 0 987 073 | 3/2000 |
| EP | 1 025 929 | 8/2000 |
| EP | 1 398 099 | 3/2004 |
| EP | 1 555 073 | 7/2005 |
| EP | 1 757 385 | 2/2007 |
| WO | WO 02/07915 | 1/2002 |

* cited by examiner

*Primary Examiner* — Kevin P Kerns
(74) *Attorney, Agent, or Firm* — Cozen O'Connor

(57) ABSTRACT

A continuous casting mold includes mold plates which enclose the casting cross section and in which cooling channels extend. The mold plates are connectable to a water box by screw elements which are formed by fastening bolts having a threaded shank which is screwable into fastening threads located in the mold plate. To achieve a uniform cooling in a continuous casting mold, the fastening threads are arranged such that their center longitudinal axes extend between two adjacent coolant channels of the plurality of cooling channels. The diameter of each threaded bore hole of the fastening threads is greater than the distance between the two adjacent cooling channels, and each bore hole of the fastening threads ends at a distance from the floor of the plurality of cooling channels to define the screw-in depth of the fastening bolts.

4 Claims, 1 Drawing Sheet

EXTRUSION DIE

CROSS-REFERENCE TO RELATED APPLICATIONS

This is a U.S. national stage of International Application No. PCT/DE2007/001884, filed on 18 Oct. 2007. Priority is claimed on German Application No. 10 2006 051 171.9, filed on 26 Oct. 2006.

BACKGROUND OF THE INVENTION

1. Field of the Invention

The invention is directed to a continuous casting mold with mold plates which enclose the casting cross section and in which cooling channels extend. The mold plates are connected to a water box by screw elements, and the screw elements are formed by fastening bolts with a threaded shank which can be screwed into fastening threads in the mold plate.

2. Description of the Related Art

With the exception of tubular molds for billets, molds for the continuous casting of steel comprise a plurality of mold plates, which together form a cavity. The molten metal is poured into this cavity, partially solidifies, and is conducted downward. The format varies between slabs, thin slabs, blooms, or beam blanks depending on the shape of this cavity.

The mold plates, which are fashioned almost exclusively from copper alloys, are acted upon by very high thermal and mechanical loads during the casting operation. The mold plates are fastened at the back to a water box so that the mold will retain its shape in spite of the forces acting on it during casting. In particular, this should prevent large gaps from forming in the area of contact between the individual mold plates of a mold. Also, the cooling water of the mold may not be allowed to escape freely and come into contact with the molten steel.

Depending on the construction and dimensions of the molds, the mold plates are fastened to the water boxes at the back in different ways. Examples for the construction of the mold plates are disclosed in EP 1 398 099 B1 and WO 02/07915.

Usually, bore holes having threads, into which bolts or screws are screwed, are located on the back of the mold plates. Here, the fastening threads or threaded bore holes must be sufficiently deep and have a sufficiently large diameter to ensure a strength sufficient to prevent the fastening elements from being torn out of the copper.

The dimensions, quantity and spacing of the threaded bore holes depend among other things on the strength of the mold material, the dimensions and shape of the mold plate and the loading during operation.

The back of the mold plates is needed not only for fastening purposes but also for dissipating the extremely large amount of heat that is released during the solidification and cooling of steel.

Accordingly, cooling channels or cooling bore holes through which the cooling water is pumped at high pressure and velocity are located on the back of the molds.

For reasons relating to product quality and the lifetime of the mold plates that are used, it is necessary to ensure that cooling over the surface of a mold plate is as uniform as possible so that individual areas of the front side of the mold do not have a substantially higher temperature than other areas immediately adjacent to them.

When the cooling water is conducted in the mold plate through cooling bore holes, the fastening threads can be located behind the cooling plane. However, producing drilled mold plates is relatively cumbersome, compared to mold plates with cut cooling channels. Further, the depth of cut cooling channels and, therefore, the distance between the cooling channels and the front side of the mold can be changed over the length and width of the mold plate and accordingly adapted to the occurring thermal loading.

The above cited WO 02/07915, publication discloses a mold arrangement in which coolant bore holes are provided parallel to one another in a copper plate. The fastening bolts are arranged so that their center longitudinal axes extend in the center between two adjacent coolant bore holes.

In this construction, the distance between the outer walls of the adjacent coolant bore holes is greater than the outer diameter of the fastening bolt or threaded bore hole into which the shank of the fastening bolt is screwed. In this arrangement, the supporting threaded portion is located in the wall between the adjacent coolant bore holes.

In the prior art, fastening bore holes and cooling channels in molds with cut cooling channels are located next to one another. Nevertheless, there are various possibilities for achieving the most uniform possible cooling of the mold plate. Additional cooling bore holes can be located in front of the threaded bore holes in the direction of the flow of heat or, rather than the cooling channels extending vertically over the height of the mold plate, at least the next channels adjacent to the row of fastening bore holes can pass around the fasteners at the smallest possible distance (slalom slot).

It is an object of the invention to arrange and form fastening bore holes and cut cooling channels on the backs of mold plates such that a virtually uniform cooling of the mold plates is achieved.

This and other objects and advantages are achieved in accordance with the invention by an embodiment with a continuous casting mold having mold plates which enclose a casting cross section and in which a plurality of cooling channels extend, where the mold plates are connected to a water box by of screw elements formed from fastening bolts having a threaded shank which is screwable into fastening threads located in the mold plate. The fastening threads are arranged such that their center longitudinal axes extend between two adjacent coolant channels of the plurality of cooling channels, the diameter of each threaded bore hole of the fastening threads is greater than the distance between the two adjacent cooling channels, and each threaded bore hole of the fastening threads ends at a distance from the floor of the plurality of cooling channels so as to define the screw-in depth of the fastening bolts.

Accordingly, the bore thread holes for the fastening threads are no longer located separately next to the cooling channels, but partially overlap the cooling channels or are intersected by them.

The fastening bolts project somewhat into the cooling channels when they are screwed into the fastening threads. However, the fastening bolts do not engage with the fastening threads in the area of the cooling channels because there is no fastening thread in this area. On the other hand, the fastening thread is also located in the wall areas of the adjacent cooling channels which face away from one another so that the tear-out strength is greater in comparison to the tear-out strength of fastening threads arranged in the middle in cooling bore holes.

Tests have been conducted which show that it is possible to produce these fastening threads without difficulty, and the production does not differ from the production of fastening threads in solid material. Further, fastening threads were examined to determine whether they possess sufficient tear-out strength. The tests showed that, under load, the channel threads have a tear-out strength comparable to that of threads in solid material. However, their diameter must be somewhat greater compared to solid threads so that they have the same supporting surface. Within the meaning of the disclosed invention, supporting surface means the supporting circumference x of the thread depth. The supporting circumference is the circumference of the thread minus the circular arcs that are cut out of the cooling channels.

It is crucial that the cooling channels are deeper than the bore holes for the fastening threads. In this way, cooling water is provided below the thread (i.e., between the hot side of the mold and the base of the fastening threads), and there is accordingly also a cooling effect in that location.

In order to ensure a uniform flow in the channels and to achieve higher flow rates, the channel cross section can be reduced above and/or below and to the sides of the fastening threads by filler pieces. There will then be islands remaining in the area of the fastenings for receiving the thread inserts.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The invention will be described more fully in the following with reference to the drawings, which.

DETAILED DESCRIPTION OF THE PREFERRED EMBODIMENTS

Figure 1:
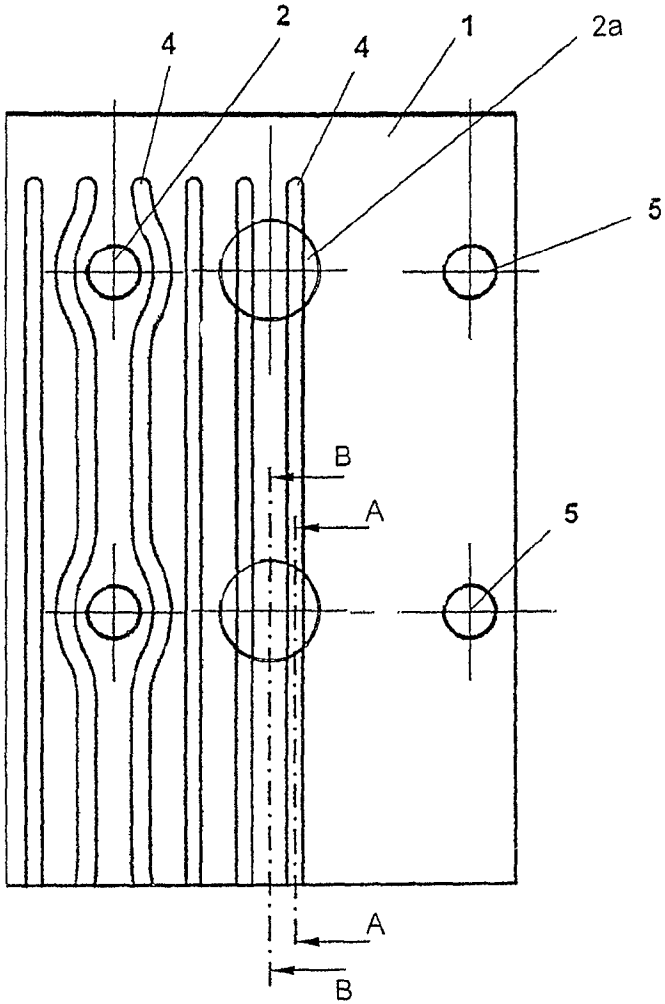
FIG. 1 is a schematic view of the arrangement and construction of fastening threads in the back of a mold plate.

The mold plate is designated by reference number 1 in FIG. 1. A known arrangement of fastening threads, which has already been referred to above as slalom slots, is shown on the left-hand side of the structure shown in FIG. 1.

The fastening threads 2 are enclosed, i.e., surrounded in a slalom shape by the cooling channels 4.

In contrast, bore holes 3 with the fastening threads 2*a* shown in the center of the mold plate 1 are arranged such that they are intersected by, or partially overlap, the cooling channels 4.

Figure 2:
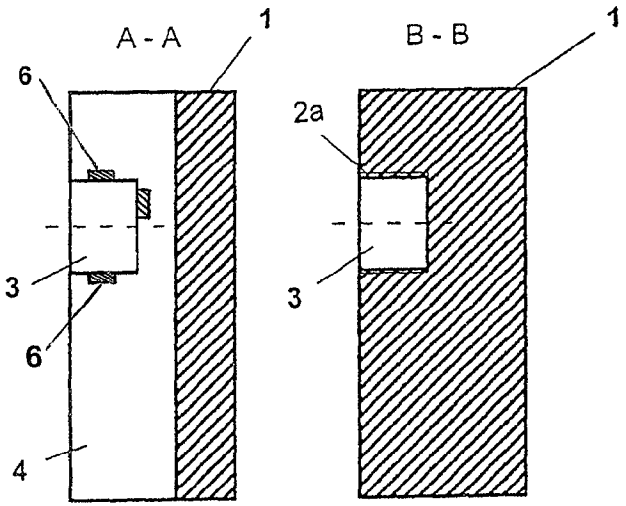
FIG. 2 is a cross-sectional view along section A-A and B-B of FIG. 1.

Naturally, the fastening thread 2*a* is not present in the area where the cooling channels 4 intersect the bore holes 3, as evident from section A-A in FIG. 2.

For comparison purposes, FIG. 1 shows small fastening threads 5 on the right-hand side which are located outside of the cooling channels and are accordingly situated in solid material. In order to achieve the same tear-out strength and the same supporting surfaces, the small fastening threads 5 need only have a smaller diameter than the fastening threads 2*a* intersected by the cooling channels because there is no supporting fastening thread in the area of the cooling channels.

Section B-B in FIG. 2 shows a cross section through the solid material of the mold plate 1, where the threaded bore hole 3 is not intersected by the cooling channel 4. The remaining fastening thread 2*a* is visible in the solid material. In certain embodiments, filler pieces 6 are provided to reduce a cross section of the cooling channels above, below and/or at the sides of the fastening thread 2*a*.

As is shown in section A-A in FIG. 2, the depth of the fastening threads 2*a* and bore holes for these threads is smaller than the depth of the cooling channels 4 so that it is possible for coolant to flow through the cooling channel even when the fastening bolts are screwed in.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. Moreover, it should be recognized that structures shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A continuous casting mold, comprising:

a mold plate which encloses a casting cross section and in which a plurality of cooling channels extend, the mold plate being connectable to a water box by screw elements formed from fastening bolts having a threaded shank which is screwable into first fastening threads located in said mold plate;

wherein the first fastening threads are arranged such that their center longitudinal axes extend between two adjacent coolant channels of said plural cooling channels, a diameter of each threaded bore hole of the first fastening threads is greater than a distance between the two adjacent cooling channels such that the threaded bore hole extends through the two adjacent coolant channels of said plural cooling channels, and each threaded bore hole of the first fastening threads ends at a distance spaced apart from a floor of the plural cooling channels so as to define a screw-in depth of the fastening bolts.

2. The continuous casting mold according to claim 1, wherein a diameter of the first fastening threads is greater than a diameter of second fastening threads arranged in a solid material portion of the mold plate so that the first and second fastening threads have a same supporting surface.

3. The continuous casting mold according to claim 1, wherein a channel cross section of the cooling channels is reduced at least one of above, below and at sides of the first fastening threads by filler pieces to ensure a uniform flow in each of said plural cooling channels and to achieve higher flow rates.

4. The continuous casting mold according to claim 2, wherein a channel cross section of the cooling channels is reduced at least one of above, below and at sides of the first fastening threads by filler pieces to ensure a uniform flow in each of said plural cooling channels and to achieve higher flow rates.

* * * * *